US009713757B2

(12) United States Patent
Wiseman et al.

(10) Patent No.: US 9,713,757 B2
(45) Date of Patent: Jul. 25, 2017

(54) GOLF GLOVE WITH CLEANING ELEMENT

(71) Applicant: RMS Glove, LLC., Farmington Hills, MI (US)

(72) Inventors: Matthew Nicholas Wiseman, Farmington Hills, MI (US); Staci Lynn Hayman, Farmington Hills, MI (US)

(73) Assignee: RMS GLOVE, LLC., Farmington Hills, MI (US)

( * ) Notice: Subject to any disclaimer, the term of this patent is extended or adjusted under 35 U.S.C. 154(b) by 256 days.

(21) Appl. No.: 14/274,451

(22) Filed: May 9, 2014

(65) Prior Publication Data

US 2015/0082514 A1 Mar. 26, 2015

Related U.S. Application Data

(63) Continuation-in-part of application No. 14/037,524, filed on Sep. 26, 2013.

(51) Int. Cl.

| | |
|---|---|
| ***A41D 19/00*** | (2006.01) |
| ***A63B 71/14*** | (2006.01) |
| ***A63B 57/60*** | (2015.01) |

(52) U.S. Cl.

CPC ..... *A63B 71/146* (2013.01); *A63B 57/60* (2015.10); *A41D 19/0024* (2013.01); *A41D 19/0037* (2013.01); *A63B 2209/10* (2013.01)

(58) Field of Classification Search

CPC ... A63B 71/146; A63B 57/60; A63B 57/0087; A63B 2209/10; A41D 19/0037; A41D 19/0024; A47L 13/18; A47L 13/19; A47K 7/02

USPC ..... 15/244.4, 210.1, 118, 227; 2/160, 159, 2/161.4, 161.6

See application file for complete search history.

(56) References Cited

U.S. PATENT DOCUMENTS

| | | | | |
|---|---|---|---|---|
| 3,885,249 A | | 5/1975 | De Brabander | |
| 4,766,611 A | * | 8/1988 | Kim | A41D 19/0027 2/160 |
| 4,805,242 A | * | 2/1989 | Bolton | A41D 19/0024 2/160 |
| 4,813,079 A | * | 3/1989 | Reitzel | A63B 21/065 2/160 |
| 4,850,052 A | * | 7/1989 | Matthews | A41D 19/0024 2/160 |
| 5,473,789 A | | 12/1995 | Oster | |
| 5,806,668 A | * | 9/1998 | Bixby | A41D 19/0068 15/227 |

(Continued)

FOREIGN PATENT DOCUMENTS

| | | |
|---|---|---|
| GB | 1350761 | 4/1974 |
| WO | WO9308709 | 5/1993 |

*Primary Examiner* — Clinton T Ostrup
*Assistant Examiner* — Abby Spatz
(74) *Attorney, Agent, or Firm* — Christopher G. Darrow; Darrow Mustafa PC

(57) ABSTRACT

A golf glove employing a cleaning member includes a palm portion and an opposing back portion having an opening for receiving the cleaning member. The cleaning member may be fixedly connected to the back portion of the glove. A flap member attached to the back portion of the glove is positionable between a closed position, in which the flap member overlays at least a portion of the cleaning member, and an open position, in which the flap member is displaced from the back portion of the glove to provide access to the cleaning member.

19 Claims, 2 Drawing Sheets

(56) References Cited

U.S. PATENT DOCUMENTS

| | | | | |
|---|---|---|---|---|
| 5,819,312 | A * | 10/1998 | Snyder | A41D 13/0593 2/16 |
| 5,956,770 | A | 9/1999 | Dennis | |
| 6,006,761 | A | 12/1999 | Meledandri | |
| 6,305,044 | B1 | 10/2001 | James et al. | |
| 6,421,836 | B1 | 7/2002 | Park | |
| 7,302,728 | B2 | 12/2007 | Kunz | |
| 2004/0031120 | A1* | 2/2004 | Cherian | A41D 19/0024 15/227 |
| 2007/0234466 | A1 | 10/2007 | Stengel | |
| 2011/0004974 | A1 | 1/2011 | Firouzman | |

* cited by examiner

GOLF GLOVE WITH CLEANING ELEMENT

RELATED APPLICATIONS

This application claims benefit of U.S. patent application Ser. No. 14/037524, filed on Sep. 26, 2013, which is herein incorporated by reference in its entirety.

BACKGROUND AND SUMMARY

It is common for golf equipment, including golf balls and clubs, to accumulate dirt and debris during use. Accumulated dirt and debris may adversely affect the performance of the equipment. This may be avoided by cleaning the equipment at various times during a round of golf. A towel may be used to remove the accumulated dirt and debris from the equipment. To provide convenient access, the towel may be attached to the user's golf bag or some other conveniently accessible location, such as a golf cart. While this may make the towel accessible for cleaning a golf club after a golf shot, it may not be particularly convenient in instances where it may be desirable to clean a golf ball that is in play on a green. In that situation the golfer must remember to remove the towel from the bag or cart and carry it with them to the green. As can be expected, that does not always occur, causing the golfer to return to their bag to retrieve the towel or use other means to clean the ball, including rubbing the ball on the ground or the golfer's clothing, neither of which may be particularly effective or desirable.

Disclosed herein is an exemplary golf glove employing a cleaning member for cleaning debris from golf equipment, such as golf clubs and a golf ball. The golf glove may include a palm portion and an opposing back portion having an opening for receiving the cleaning member. The cleaning member may be fixedly connected to the back portion of the glove. A flap member attached to the back portion of the glove may be selectively moved between a closed position, in which the flap member overlays at least a portion of the cleaning member, and an open position, in which the flap member is displaced from the back portion of the glove to provide access to the cleaning member.

BRIEF DESCRIPTION OF THE DRAWINGS

The various features, advantages and other uses of the present apparatus will become more apparent by referring to the following detailed description and drawings in which.

DETAILED DESCRIPTION

Figure 1:
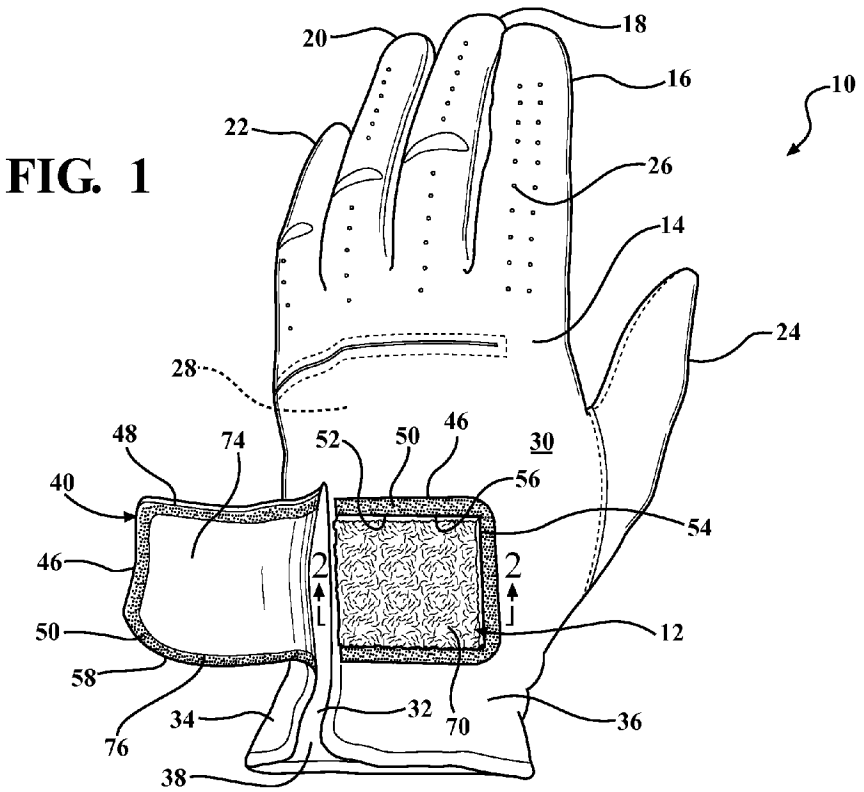
FIG. 1 is a top view of a golf glove employing an exemplary detachable cleaning member.
Figure 2:
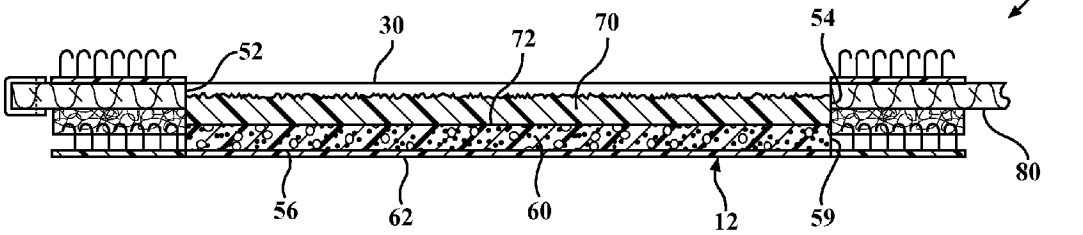
FIG. 2 is a partial cross-sectional view of the golf glove and detachable cleaning member of FIG. 1.

With reference to FIGS. 1-4, a golf glove 10 may include an exemplary cleaning member 12 for removing dirt and debris from golf equipment, and in particular, golf balls. The golf glove 10 may include an anatomically contoured cover 14 that generally conforms to a user's hand. The glove 10 may include four finger covers 16, 18, 20, 22 and a thumb cover 24. Although illustrated as including complete finger covers 16, 18, 20, 22 and thumb cover 24. One or more of the finger and thumb covers may include a partial cover. The glove 10 may include openings 26 in the cover 14 to provide ventilation.

The glove 10 may further include a palm portion 28 and an opposing back portion 30 that connects to the palm portion 28. The back portion 30 extends along a back of a user's hand when worn. The back portion 30 may include a slit 32 that separates a first back section 34 from a second back section 36. For purposes of discussion, the slit 32 is illustrated positioned near an edge of the back portion 30, but may also be positioned at other locations on the glove 10. The slit 32 enables a hand opening 38 of the glove 10 to be enlarged to allow a user's hand to more easily be inserted into the glove 10.

Figure 3:
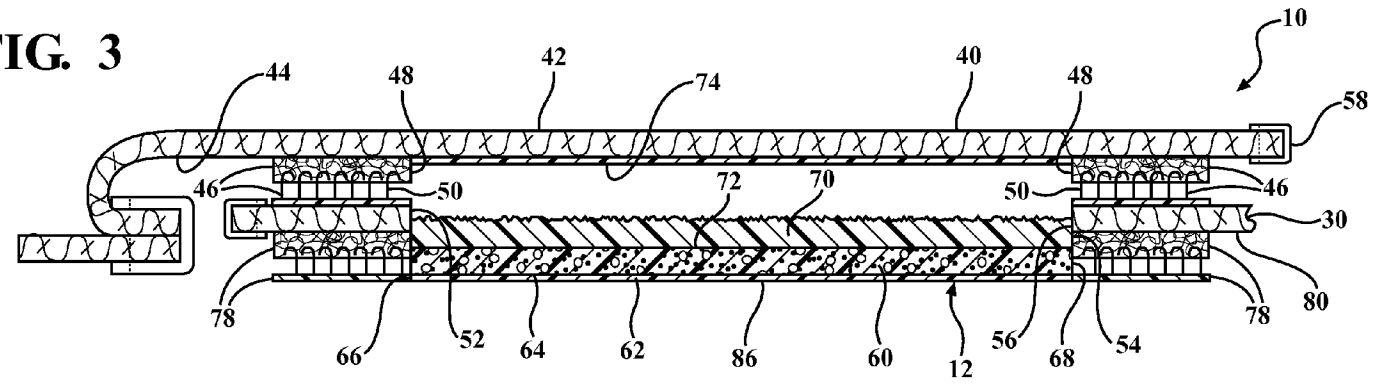
FIG. 3 is a partial cross-sectional view of the golf glove and detachable cleaning member of FIG. 1 with a flap member of the glove arranged in a closed position.
Figure 4:
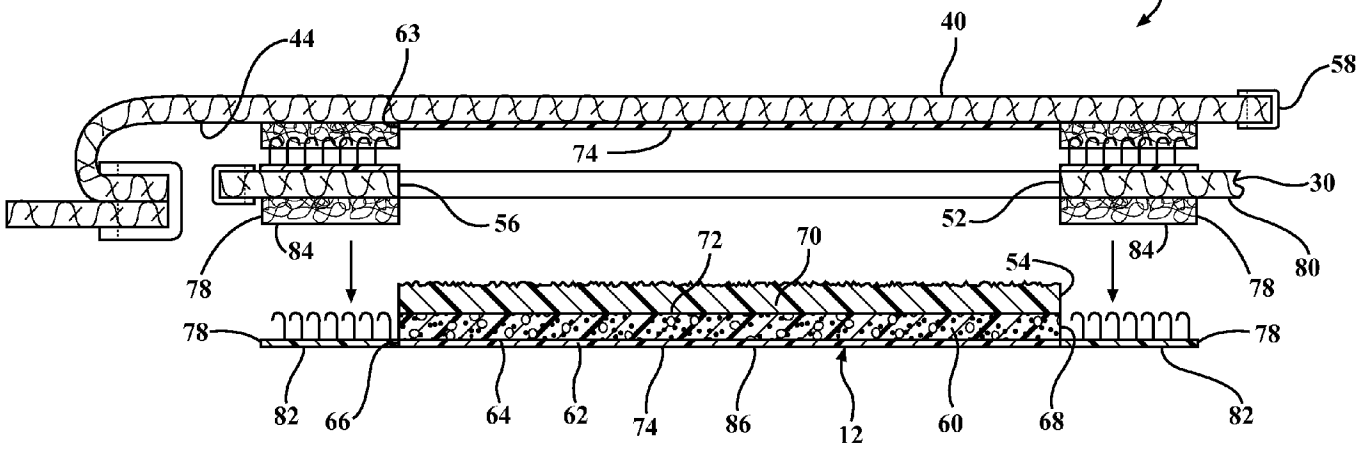
FIG. 4 is partial cross-sectional view of the golf glove and detachable cleaning member of FIG. 1 with the cleaning member removed from the glove.

With particular reference to FIGS. 1, 3 and 4, a flap member 40 may be provided to secure the glove 10 around the user's hand and wrist. The flap member 40 may be attached to the first back section 34 on one side of the slit 32 using various permanent or detachable connection techniques, such as sewing, snaps, hooks, adhesives and zippers, as well as other techniques. The flap member 40 includes an exterior surface 42 and an interior surface 44 (see FIG. 3). A releasable fastener 46 may be employed for connecting the flap member 40 to the second back section 36 on the other side of the slit 32. The releasable fastener 46 may include a first fastener member 48 attached to the flap member 40. A corresponding second fastener member 50, which cooperates with the first fastener member 48, may be attached to the second back section 36 of the glove 10.

The releasable fastener 46 may have any of a variety of configurations, including but not limited to, hook-and-loop fasteners, zippers, snaps, hooks, and magnets, to name a few. Other configurations of releasable connectors may also be employed. An example of a releasable fastener configuration may include a hook-and-loop fastener having a loop portion and hook portion that cooperatively engages the loop portion and which enables the two fastener portions to be repeatedly connected and disconnected from one another. When utilizing a hook-and-loop type fastener, the first fastener member 48 may include the loop portion of the fastener and the second fastener member 50 may include the hook portion. The arrangement of the hook and loop portions may alternatively be reversed, such that the first fastener member 48 includes the hook portion and the second fastener member 50 includes the loop portion. An advantage of a hook-and-loop style fastener is it enables the flap member 40 to be attached to the second back section 36 of the glove in various positions, thereby providing the user greater control over the "fit" of the glove.

With the flap member 40 detached from the back portion 30 of the glove (i.e., in an open position), for example, as shown in FIG. 1, the edges of the slit 32 may be spread apart to allow the user to place the glove 10 on their hand. The first back section 34 may then be drawn toward the second back section 36 by pulling the flap member 40 away from the first back section 34 and toward the second back section 36. This adjusts a "fit" of the glove 10 about the user's wrist and hand. To maintain the desired fit, the flap member 40 may be attached to the second back section 36 of the glove, for example, as illustrated in FIG. 3, by engaging the first fastener member 48 with the second fastener member 50. The flap member 40 may be selectively detached from second back section 36 of the glove by pulling the flap member 40 away from the back section 36 to disengage the first fastener member 48 attached to the flap member 40 from the second fastener member 50 attached to the back section 36 of the glove.

Continuing to reference FIGS. 1-4, the cleaning member 12 may be positioned within an opening 52 formed in the second back section 36 of the glove 10. The cleaning member 12 extends through the opening 52 in the glove 10 so as to be accessible from outside the glove when the glove is attached to the user's hand. The opening 52 in the glove 10 may be configured to have a similar shape as an outer perimeter 54 of the cleaning member 12. The opening 52 may be sized larger than cleaning member 12 to enable generally unobstructed positioning of the cleaning member 12 within the opening 52

The cleaning member 12 may be positioned on the glove 10 in the footprint of the flap member 40 or otherwise in a location that enables the flap member 40 to at least partially cover the cleaning member 12 when the flap member 40 is attached to the second back section 36 of the glove 10, for example, as illustrated in FIG. 3. This arrangement provides protection for the cleaning member 12 and helps retain liquids that may be present in the cleaning member 12. The user may access the cleaning member by selectively detaching the flap member 40 from the second back section 36 of the glove 10.

The second fastener member 50 may be positioned adjacent opening 52 in the glove 10, but need not extend around an entire perimeter 56 of the opening 10. The second fastener member 50 may be configured as a single uninterrupted fastener, or may consist of multiple fasteners positioned at various locations around the perimeter 56 of the opening 52.

The first fastener member 48 may be positioned along the interior surface 44 of the flap member 40 so as to generally align with the second fastener member 50 when connecting the flap member 40 to the second back section 36 of the glove 10. Although the first fastener member 48 is illustrated as a continuous strip extending along a perimeter 58 of the flap member 40, the first fastener member 48 may alternatively be configured to extend over a larger portion of the interior surface 44 of the flap member 40, and may cover the entire interior surface. Rather than being configured as one continuous uninterrupted strip, the first fastener member 48 may also include multiple discrete fastener members arranged along the interior surface 44 of the flap member 40 at locations appropriate for engaging the second fastener member 50 when attaching the flap member 40 to the second back section 36 of the glove 10.

The cleaning member 12 may include various elements depending, at least in part, on the design and performance requirements of a particular application. For example, with particular reference to FIG. 4, the cleaning member 12 may include a liquid retaining member 60 capable of absorbing and temporarily retaining a liquid, such as water or an aqueous solution. The liquid retaining member 60 may consist of a porous or semi-porous material made from any of a variety of materials, such as cellulose wood fibers, sodium sulphate crystals, hemp fibers or foamed plastic polymers, as well as other materials, and may include low-density polyether, polyvinyl alcohol (PVA), and polyester. The liquid retaining member 60 may be constructed from interwoven fibers or may have another construction. The precise configuration and material formulation of the liquid retaining member 60 may be varied so long as the resulting material is capable of absorbing and at least temporarily retaining a liquid. Applying pressure to the liquid retaining member 60 will cause at least a portion of the absorbed liquid to be released from the liquid retaining member 60.

The cleaning member 12 may also include a liquid barrier 62 positioned along an inside surface 64 of the liquid retaining member 60. The liquid barrier 62 provides a generally waterproof barrier between the liquid retaining member 60 and the user's hand. The liquid barrier 62 may be sized to generally conform to the shape of the liquid retaining layer 60, such that an outer perimeter 66 of the liquid barrier 62 generally corresponds to an outer perimeter 68 of the liquid retaining member 60. Alternatively, the liquid barrier 62 may be sized larger than the liquid retaining member 60.

To enhance the cleaning capability of the cleaning member 12, a scrubbing member 70 may be positioned along an outside surface 72 of the liquid retaining member 60. The scrubbing member 70 may have a generally porous configuration to allow liquid to pass through the scrubbing member. The scrubbing member 70 may have various configurations, which may include, for example, generally upstanding bristles arranged to form a brush or multiple strands woven together to form a pad. The scrubbing member 70 may be constructed from any of a variety of materials that are generally resistant to wear and tear that the cleaning member may encounter. Although illustrated as having the same general size as the liquid retaining member 60, in practice the scrubbing member 70 may also be sized larger or smaller than the liquid retaining member 60.

It is not necessary that the cleaning member 12 include each of the liquid retaining member 60, liquid barrier 62 and scrubbing member 70, and may include fewer than all three components. The cleaning member 12 may also include additional components.

With particular reference to FIGS. 1 and 3, the glove 10 may include a liquid barrier 74 located along the interior surface 44 of the flap member 40. Similar to liquid barrier 62, liquid barrier 74 may be configured to generally prevent liquid from passing between the liquid retaining member 60 and the flap member 40. The liquid barrier 74 may be sized to generally conform to the size and shape of the liquid retaining member 60. The liquid barrier 74 may be attached to the flap member 40 using a variety of techniques, for example, stitching and adhesives. The liquid barrier 74 may alternatively be sized larger than the liquid retaining member 60. At least a portion of the first fastener member 48 may be positioned outside an outer perimeter 76 of the liquid barrier 62 so as to be accessible for connecting to the second fastener member 50 attached to the second back section 36 of the glove 10.

With reference to FIGS. 3 and 4, a releasable cleaning member fastener 78 may be provided for detachably connecting the cleaning member 12 to an inside surface 80 of the second back section 36 of the glove 10. The ability to selectively detach the cleaning member 12 from the glove 10 enables the cleaning member 12 to be cleaned or replaced, as may be required, without having to replace the entire glove.

The cleaning member fastener 78 may be configured similar to releasable fastener 46 used to releasably connect the flap member 40 to the second back section 36 of the glove 10 (see for example, FIGS. 1, 3 and 4). The cleaning member fastener 78 may include any of a variety of configurations, including but not limited to, hook-and-loop fasteners, zippers, snaps, hooks, and magnets, to name a few. Other configurations of releasable connectors may also be employed. For purposes of discussion, the illustrated exemplary configuration utilizes a hook-and-loop style connector for releasably connecting the cleaning member 12 to the inside surface 80 of the glove 10.

The cleaning member fastener 78 may include a first cleaning member fastener 82 attached to the cleaning member 12 that cooperatively engages a second cleaning member fastener 84 attached to the inside surface 80 of the glove 10. The first cleaning member fastener 82 may include the loop portion of the connector and the second cleaning member fastener 84 may include the hook portion. The arrangement of the hook and loop portions of the cleaning member fastener 82 may alternatively be reversed, such that the first cleaning member fastener 82 includes the hook portion of the connector and the second cleaning member fastener 84 includes the loop portion.

The first cleaning member fastener 82 may be attached to a backside 86 of the cleaning member 12, or another other portion of the cleaning member 12. For example, the first cleaning member fastener 82 may be attached to the liquid barrier 62. The first cleaning member fastener 82 may at least partially extend along the backside 86 of the cleaning member 12, and may be integrally formed with the liquid barrier 62.

The first cleaning member fastener 82 cooperatively engages the second cleaning member fastener 84 attached to the inside surface 80 of the glove 10. The second cleaning member fastener 84 may be positioned adjacent the opening 52 in the glove 10, but need not extend around an entire perimeter 56 of the opening 10. The second cleaning member fastener 84 may be configured as a single uninterrupted fastener, or may consist of multiple fasteners positioned at various locations around the perimeter 56 of the opening 52.

The cleaning member 12 may be selectively attached to the glove 10 by inserting the cleaning member 12 through the hand opening 38 and guiding the cleaning member 12 into the opening 52 in the back portion 30 of the glove 10. The cleaning member 12 may be attached to the glove 10 by engaging the first cleaning member fastener 82 with the second cleaning member fastener 84.

The cleaning member 12 may be selectively detached from the glove 10 by pulling the cleaning member 12 away from the inside surface 80 of the glove 10 to disengage the first cleaning member fastener 82 from the second cleaning member fastener 84 attached to the inside surface 80 of the glove 10. The cleaning member 12 may then be removed from the glove 10 through the hand opening 38.

While recited characteristics and conditions of the invention have been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A golf glove, comprising:

a cover configured as a sheath for a hand and having an outermost surface and an innermost surface defining a hand cavity, the cover including a hand opening that opens to the hand cavity, a palm portion, a back portion opposing the palm portion, and a slit across the back portion enabling different sizes of the hand opening;

a flap member fixedly attached to the cover on one side of the slit, and having a free end, the free end detachably and reattachably attached to the cover on the other side of the slit in an overlying relationship with the outermost surface of the cover to maintain a size of the hand opening;

a cleaning member opening that opens from the innermost surface of the cover to the outermost surface of the cover in the footprint of the free end of the flap member, to thereby be accessible from the hand opening; and a standalone cleaning member received within the cleaning member opening and thereby underlying the free end of the flap member in the footprint of the free end of the flap member, and detachably and reattachably attached to the innermost surface of the cover as an integral unit, the standalone cleaning member including a retaining material configured to absorb and retain liquid, a porous outermost surface in liquid communication with the retaining material and sized and configured to remove dirt and debris from a golf ball, and a barrier material completely separating the retaining material from liquid communication with the hand cavity.

2. The golf glove of claim 1, wherein the standalone cleaning member includes a layer of the barrier material, a layer of the retaining material overlying the layer of the barrier material, and a layer of scrubbing material overlying the layer of the retaining material and defining the porous outermost surface.

3. The golf glove of claim 2, wherein the layer of the barrier material, the layer of the retaining material and the layer of scrubbing material are fixedly attached together.

4. The golf glove of claim 2, wherein the layer of the barrier material is larger than the cleaning member opening and overlies the innermost surface of the cover, the standalone cleaning member is detachably and reattachably attached to the innermost surface of the cover by the layer of the barrier material, and the layer of scrubbing material is received within the cleaning member opening.

5. The golf glove of claim 4, further comprising:

a first fastener member fixedly attached to the layer of the barrier material along a perimeter of the layer of scrubbing material; and a second fastener member overlying the innermost surface of the cover and bordering multiple sides of the cleaning member opening in coincidence with the first fastener member, and fixedly attached to the cover, wherein:

the first fastener member and the second fastener member are cooperatively engaged to detachably and reattachably attach the standalone cleaning member to the innermost surface of the cover by the layer of the barrier material.

6. The golf glove of claim 5, wherein both the first fastener member and the second fastener member are hook-and-loop fasteners.

7. The golf glove of claim 1, wherein the free end of the flap member has a perimeter along which the free end of the flap member is attached to the cover, and the attachment between the perimeter of the free end of the flap member and the cover borders multiple sides of the standalone cleaning member.

8. The golf glove of claim 1, wherein the free end of the flap member has a perimeter along which the free end of the flap member is attached to the cover, and the attachment between the perimeter of the free end of the flap member and the cover borders three sides of the standalone cleaning member.

9. The golf glove of claim 1, further comprising:

a first fastener member overlying an ultimate interior surface of the flap member along a perimeter of the free end of the flap member, and fixedly attached to the flap member; and a second fastener member overlying the outermost surface of the cover and bordering multiple sides of the standalone cleaning member in coincidence with the first fastener member, and fixedly attached to the cover, wherein:

the first fastener member and the second fastener member are cooperatively engaged to detachably and reattachably attach the free end of the flap member to the cover.

10. The golf glove of claim 9, wherein both the first fastener member and the second fastener member are hook-and-loop fasteners.

11. The golf glove of claim 1, further comprising:

a layer of second barrier material overlying an ultimate interior surface of the flap member and completely separating the free end of the flap member from liquid communication with the porous outermost surface of the standalone cleaning member, and fixedly attached to the flap member.

12. The golf glove of claim 1, wherein the cover consists of a single layer of material where the cleaning member opening opens from the innermost surface of the cover to the outermost surface of the cover.

13. The golf glove of claim 1, wherein the cover includes a plurality of individual finger covers.

14. The golf glove of claim 1, wherein the cover includes four individual finger covers and a thumb cover.

15. A system for removing dirt and debris from a golf ball, comprising:

a standalone cleaning member whose components are fixedly attached together as an integral unit the standalone cleaning member including: a layer of barrier material, a layer of retaining material overlying the layer of barrier material and completely separated from liquid communication through the layer of barrier material by the layer of barrier material, the layer of retaining material configured to absorb and retain liquid, a layer of scrubbing material overlying the layer of retaining material, the layer of scrubbing material defining a porous outermost surface of the standalone cleaning member, the porous outermost surface in liquid communication with the layer of retaining material, and sized and configured to remove dirt and debris from a golf ball, and a first fastener member overlying the layer of barrier material along a perimeter of the layer of scrubbing material; and a golf glove, the golf glove including:

a cover configured as a sheath for a hand and having an outermost surface and an innermost surface defining a hand cavity, the cover including a hand opening that opens to the hand cavity, a palm portion, and a back portion opposing the palm portion, a cleaning member opening that opens from the innermost surface of the cover to the outermost surface of the cover, to thereby be accessible from the hand opening, and a second fastener member overlying the innermost surface of the cover and bordering multiple sides of the cleaning member opening for coincidence with the first fastener member, and fixedly attached to the cover, wherein:

the first fastener member and the second fastener member are cooperatively engaged to detachably and reattachably attach the standalone cleaning member to the innermost surface of the cover by the layer of barrier material and thereby receive the standalone, cleaning member within the cleaning member opening.

16. The system of claim 15, wherein both the first fastener member and the second fastener member are hook-and-loop fasteners.

17. The system of claim 15, wherein, in the golf glove:

the cover includes a slit across the back portion enabling different sizes of the hand opening;

the golf glove further includes a flap member fixedly attached to the cover on one side of the slit, and having a free end, the free end detachably and reattachably attached to the cover on the other side of the slit in an overlying relationship with the outermost surface of the cover to maintain a size of the hand opening; and the cleaning member opening opens from the innermost surface of the cover to the outermost surface of the cover in the footprint of the free end of the flap member.

18. The system of claim 16, wherein the free end of the flap member has a perimeter along which the free end of the flap member is attached to the cover, and the attachment between the perimeter of the free end of the flap member and the cover borders multiple sides of the cleaning member opening.

19. The system of claim 16, wherein the free end of the flap member has a perimeter along which the free end of the flap member is attached to the cover, and the attachment between the perimeter of the free end of the flap member and the cover borders three sides of the cleaning member opening.

* * * * *